US006536320B2

(12) United States Patent
Seyna et al.

(10) Patent No.: US 6,536,320 B2
(45) **Date of Patent: *Mar. 25, 2003**

(54) SLITTER CUTTING ELEMENT AND METHOD OF MAKING SAME

(75) Inventors: John J. Seyna, Williamson, NY (US); Michael K. Budinski, Pittsford, NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 159 days.

(21) Appl. No.: 09/195,901

(22) Filed: Nov. 19, 1998

(65) Prior Publication Data

US 2001/0037713 A1 Nov. 8, 2001

(51) Int. Cl.[7] ..... B26D 1/24; B26D 7/26; B21K 5/00

(52) U.S. Cl. ..... 83/698.31; 83/501; 83/698.41; 76/115

(58) Field of Search ..... 83/501, 500, 502, 83/503, 698.31, 698.41; 76/115

(56) References Cited

U.S. PATENT DOCUMENTS

| | | | | | |
|---|---|---|---|---|---|
| 3,122,040 | A | * | 2/1964 | Bishop | 83/698.41 X |
| 3,186,281 | A | * | 6/1965 | Wingen | 83/501 |
| 3,705,526 | A | * | 12/1972 | Bishop | 83/698.41 |
| 3,805,661 | A | * | 4/1974 | Tuomaala | 83/698.41 |
| 3,835,736 | A | * | 9/1974 | Young, Jr. et al. | 83/698.41 |
| 3,877,335 | A | | 4/1975 | Lange | |
| 3,894,462 | A | * | 7/1975 | Lundtoft | 83/698.41 |
| 3,899,948 | A | * | 8/1975 | Jakob | 83/502 X |
| 4,492,135 | A | | 1/1985 | Ginn et al. | |
| 4,854,204 | A | * | 8/1989 | Faltin | 83/500 |
| 5,048,388 | A | * | 9/1991 | Kobayashi et al. | 83/698.41 |
| 5,085,110 | A | * | 2/1992 | Scholtysik et al. | 83/501 |
| 5,138,921 | A | * | 8/1992 | Winckler | 83/501 |
| 6,308,601 | B1 | * | 10/2001 | Seyna et al. | 83/56 |

FOREIGN PATENT DOCUMENTS

| | | |
|---|---|---|
| JP | 61035933 | 2/1986 |
| WO | WO 89/04746 | 6/1989 |

* cited by examiner

*Primary Examiner*—Charles Goodman
(74) *Attorney, Agent, or Firm*—Clyde E. Bailey, Sr.

(57) ABSTRACT

A slitter cutting element for slitting a sheet of web material has an axially displaceable blade member arranged on a blade carrier. The axially displaceable blade member is biased by an elastomeric biasing member that provides a continuous and uniform contact force with a face of the blade member. The elastomeric biasing member is restrained from axial expansion by being bonded to the blade carrier.

7 Claims, 11 Drawing Sheets

SLITTER CUTTING ELEMENT AND METHOD OF MAKING SAME

FIELD OF THE INVENTION

The invention relates generally to the field of slitters for slitting sheets of material. More particularly, the invention concerns a slitter cutting element uniformly biased about a blade carrier member by an elastomeric biasing member for precisely slitting thin sheets of media, such as photographic paper and film.

BACKGROUND OF THE INVENTION

Conventional slitting devices used for slitting thin media, such as photographic paper and film, employ some sort of biasing member to control the contact force between cooperating blades or knife members. Typically such media is mass produced in large width master coils and then is cut to narrow width coils from the master coil using such slitting knives. Skilled artisans will appreciate that contact force is the force that one blade member exerts upon the other during a cutting operation.

Some success has been achieved in the art with a variety of biasing members, typically springs, presently used for biasing slitter blade members in an attempt to control the contact force between contacting blades. As shown in prior art FIGS. 1 and 2, the contact force between existing displaceable and stationary slitter knives or blade members 10, 12 is typically created by using a spring system 14 behind the displaceable blade member or knife 10. Various types of springs are currently in use, including coil 16 (illustrated in FIG. 3A), Belleville™ 18 (illustrated in FIG. 4A), and garter 20 (illustrated in FIG. 5A). In each of these prior art devices, knives or blades 10, 12, are attached to a knife or blade carrier 22 via some sort of attachment, such as a retainer ring 24 (FIGS. 4A and 5A) or screws 26 (FIGS. 1–3A). Despite the progress accomplished with the above biasing members, a major shortcoming associated with each of these various biasing springs is that they create uneven spring forces around the circumference of the knife or blade member, as depicted in FIGS. 3B, 4B, and 5B. Experienced artisans will appreciate that these variations in spring force adversely affects the wear of the slitter knives as well as the quality of the slit edge.

Therefore, there persists a need in the art for a slitter element useable in an apparatus for slitting thin media, such as photographic paper and film, that provides uniform media slitting resulting from a uniform contact force between cooperating engaging blade members of the slitting device.

SUMMARY OF THE INVENTION

It is, therefore, an object of the invention to provide a slitter cutting element in which a blade member is uniformly biased about the circumference of a blade carrier.

It is another object of the invention to provide a slitter cutting element in which an elastomeric biasing member is arranged in biasing contact with the blade member.

It is yet another object of the invention to provide a slitter cutting element in which the elastomeric biasing member is bonded circumferentially to the blade carrier.

The present invention is directed to overcoming one or more of the problems set forth above. Briefly summarized, according to one aspect of the present invention, a slitter cutting element comprises:

a blade carrier; and, a blade member arranged on the blade carrier, the blade member being biased by an elastomeric biasing member fixedly arranged in a recess formed in the blade carrier such that a portion of the elastomeric biasing member protrudes axially from the recess towards an inactive face of the blade member for continuous biasing contact with the inactive face of the blade member.

In another aspect of the invention, a method of making a slitter cutting element includes the steps of:

(a) providing a blade carrier; and, (b) providing a blade member configured for arranging on the blade carrier;

(c) providing a elastomeric biasing member configured for arranging on the blade carrier;

(d) arranging the elastomeric biasing member on the blade carrier for continuous bias contact with a non-active face of the blade member; and, (e) arranging the blade member on the blade carrier so that the non-active face is in intimate biasing contact with the elastomeric biasing member.

The present invention has numerous advantageous effects over prior art developments. First, when used in a slitter knife system, the circumferential force-deflection response of the elastomer spring is linear and more uniform compared with conventional spring designs.

Further, elastomeric slitter knife springs reduce the time required to set up a slitter knife assembly. Compared with conventional spring designs, no shimming, sorting, or other adjustments are required with elastomeric springs.

Also, elastomeric springs may be readily designed to have the desired force-deflection response. In general, elastomer springs appear to have more consistent force-deflection characteristics from spring to spring compared with coil and Belleville springs.

Moreover, a blade member biased by an elastomeric spring offers more uniform circumferential forces, longer life, elimination of fretting corrosion, and easier knife assembly.

Still further, conventional springs, such as the ones referred to above, are fabricated from metallic materials. During slitting, the motion of the springs relative to the metallic knife and collar causes fretting wear and corrosion. In manufacturing photographic products, the iron-based fretting wear debris generated by these spring materials is unacceptable. Slitter knife assemblies with elastomeric springs do not generate fretting wear debris.

Finally, since elastomers may be molded, the cross-sectional profile of the spring may be controlled to provide the desired force-deflection response. Because of their toughness, corrosion resistance, durability, resistance to compression set, wide range of durometer hardness, and ease of manufacture (e.g. casting or molding), polyurethane elastomers are particularly advantageous for spring applications.

BRIEF DESCRIPTION OF THE DRAWINGS

The foregoing as well as other objects, features and advantages of this invention will become more apparent from the appended Figures, wherein like reference numerals denote like elements, and wherein.

DETAILED DESCRIPTION OF THE INVENTION

Figure 6A:
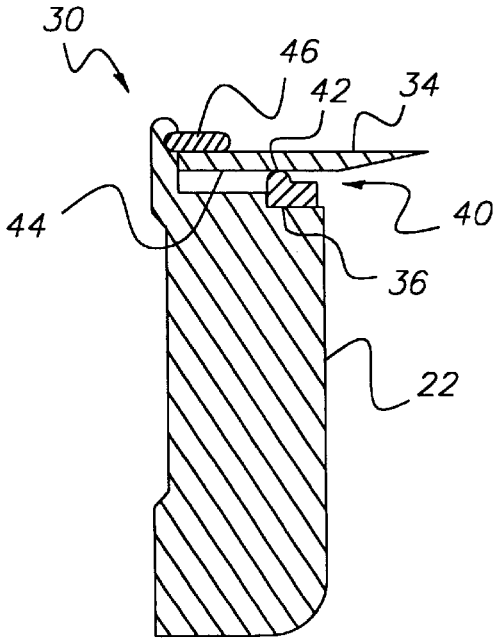
FIG. 6A is a cross-section of an axially displaceable slitter knife biased by an elastomeric spring of the invention.

Turning now to the drawings, and in particular to FIG. 6A, in one embodiment of the invention, slitter cutting element 30 having utility in, for instance, a slitting apparatus 50 (FIG. 12) for slitting a sheet of web material, such as photographic paper or film, broadly defined, comprises a blade carrier 22 and a blade member 34 fixedly attached to the blade carrier 22. Blade member 34 is attached for axial displacement about blade carrier 22 relative to a frame 52 (shown in FIG. 12 and discussed below). Generally, blade member 34 may be attached to blade carrier 22 by any number of ways with substantially similar results, for instance, by screws or retainer (46). We prefer using a retainer 46 for simplicity. In a preferred embodiment, blade carrier 22 is preferably a generally cylindrical shaped, solid body and made from a metallic material, such as hardened or stainless steel. Similarly, blade member 34 is preferably generally circular for circumferentially mounting on blade carrier 22. A groove or recess 36 is formed in the circumference of blade carrier 22 for accommodating an elastomeric biasing member or spring 40, described below.

Figure 1:
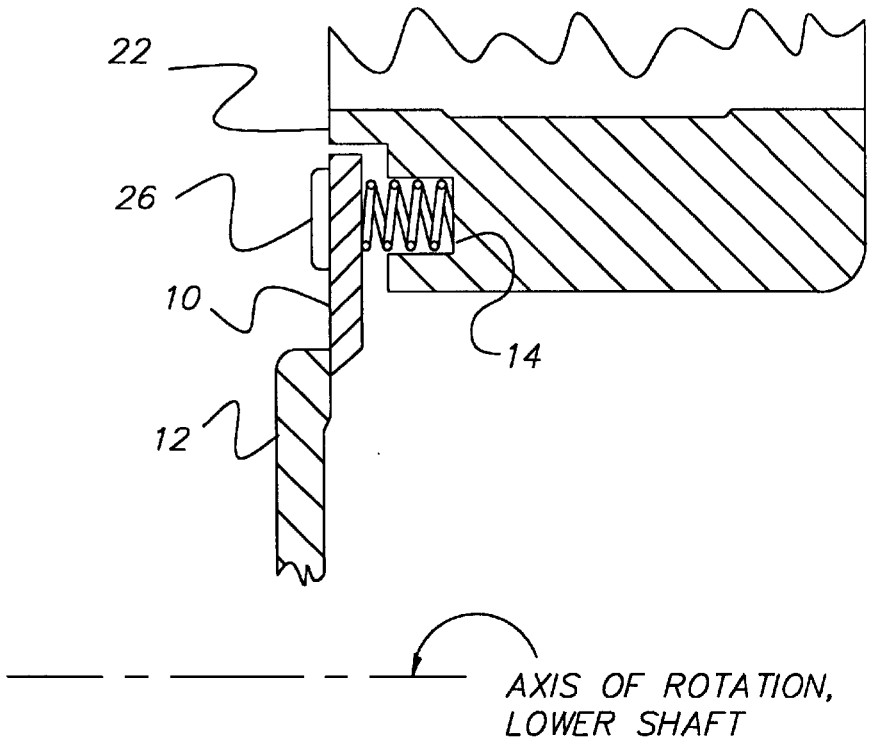
FIG. 1 (PRIOR ART)
FIG. 1 is a prior art slitting blade arrangement.
Figure 2:
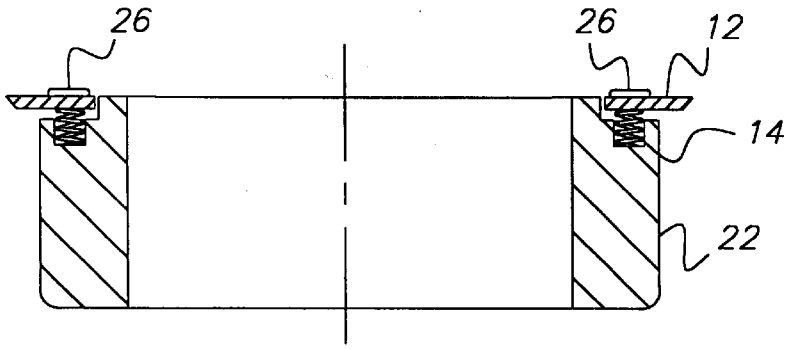
FIG. 2 (PRIOR ART)
FIG. 2 is a cross-section of the displaceable slitter blade shown in FIG. 1 showing the location of a compression spring, the knife blade, and retaining screws.
Figure 3A:
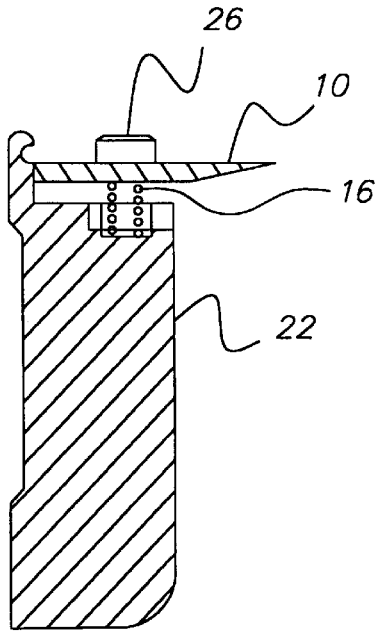
FIG. 3A (PRIOR ART)
FIG. 3A is a cross-section of a prior art displaceable slitter knife biased by a compression spring.
Figure 3B:
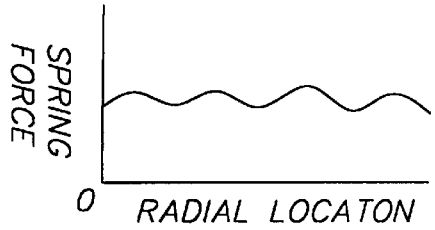
FIG. 3B (PRIOR ART)
FIG. 3B is a graphical representation of the circumferential spring force around the knife assembly illustrated in FIG. 3A.
Figure 4A:
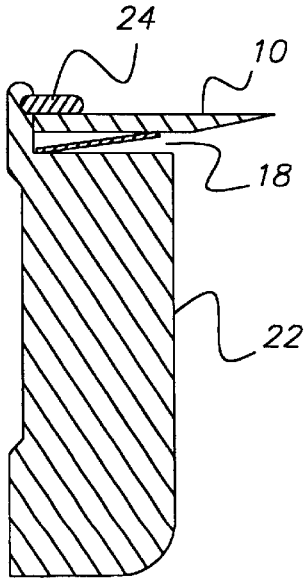
FIG. 4A (PRIOR ART)
FIG. 4A is a cross-section of a prior art displaceable slitter knife biased by a Belleville spring.
Figure 4B:
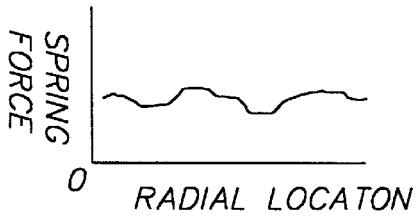
FIG. 4B (PRIOR ART)
FIG. 4B is a graphical representation of the prior art circumferential spring force around the knife assembly of FIG. 4A.
Figure 5A:
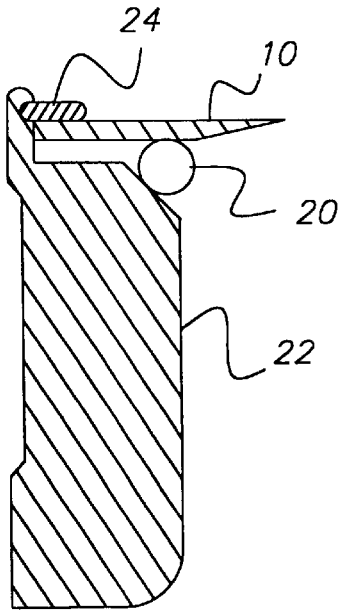
FIG. 5A (PRIOR ART)
FIG. 5A is a cross-section of a prior art displaceable slitter knife biased by a garter spring.
Figure 5B:
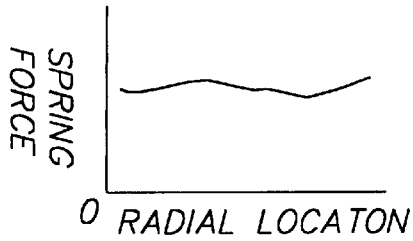
FIG. 5B (PRIOR ART)
FIG. 5B is a graphical representation of the prior art circumferential spring force around the knife assembly of FIG. 5A.
Figure 6B:
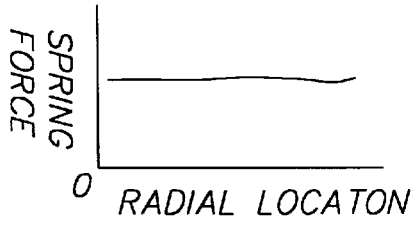
FIG. 6B is a graphical representation of the circumferential spring force around the knife assembly illustrated in FIG. 6A.

According to our invention, uniform axial displacement of blade member 34 is produced by elastomeric biasing member or spring 40 (described in greater details below) fixedly arranged in recess 36. According to FIG. 6A, a protruding, dome-liked shaped portion 42 of elastomeric biasing member or spring 40 and an inactive (i.e., a non-shearing) face 44 of blade member 34 are in continuous biasing contact. Thus, when a force is applied normal to an active face (not shown) of blade member 34, for instance by stationary blade member during a slitting cycle (see FIG. 12), the opposed inactive face 44 of blade member 34 compresses the dome-liked shaped portion 42 of elastomeric biasing member or spring 40. In response, the elastomeric biasing member or spring 40 exerts an evenly distributed opposing force about the inactive face 44 of blade member 34 thereby assuring a uniform contact force between the two other blade members, as shown in FIG. 6B. Unexpectedly, the spring force profile of our elastomeric biasing member or spring 40 is generally linear about blade member 34; whereas, marked variability in spring force about the test blade member was exhibited by prior art springs (refer to FIGS. 3B, 4B and 5B).

Skilled artisans will appreciate that various formulation models exist for making elastomeric springs. We prefer using a finite element formulation model to determine the elastomer spring design of the invention. Based on geometrical constraints, force-deflection requirements, and an assumed spring profile (or cross-section), the elastic modulus of the spring material was solved using an axiosymmetric finite element model.

Polyester polyurethane elastomer was selected as our preferred candidate material for elastomeric biasing member or spring 40 because of its durability, formability, corrosion resistance, and excellent resistance to compression set. To ensure good resiliency, the elastomeric spring material should have a durometer hardness between about 20–70 Shore A, preferably between about 25 and 35 Shore A.

Figure 7:
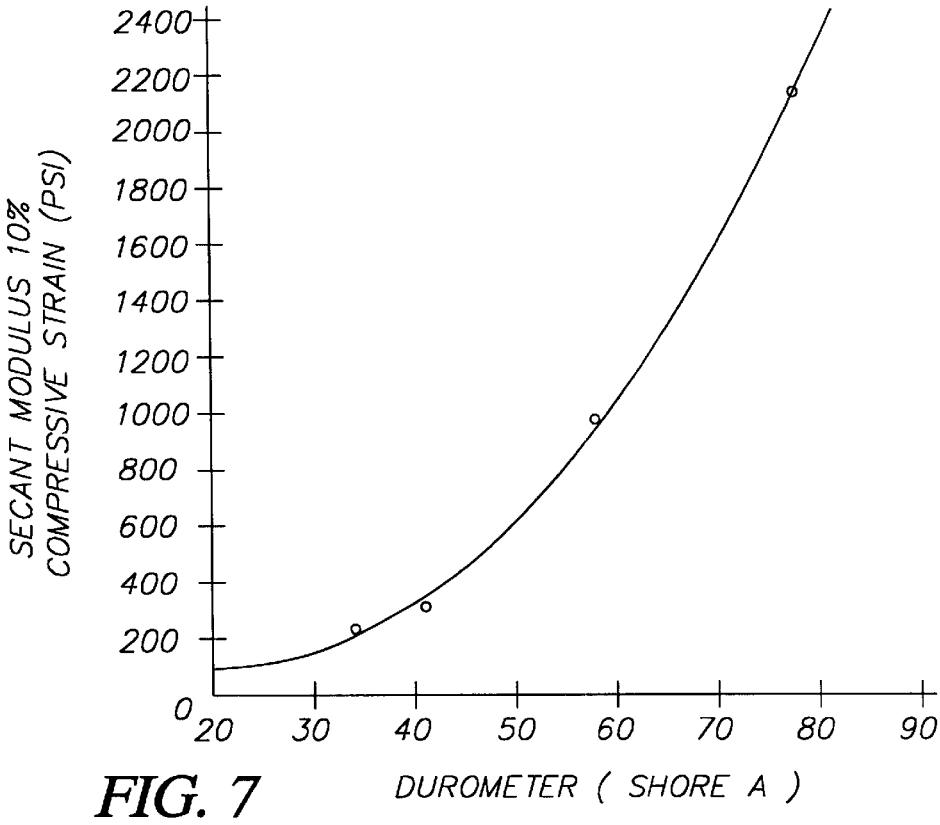
FIG. 7 is a graph showing the relationship between compressive secant elastic modulus of typical polyester polyurethane elastomers and durometer hardness used in the biasing member of the invention.

Referring to FIG. 7, the compression modulus of polyurethane as a function of durometer for the elastomeric biasing member or spring 40 of the invention is illustrated. The results indicate that based on the finite element formulation model above, a polyurethane elastomer having an internal pressure of 250 psi is approximately the equivalent of about 33 Shore A. It is our experience that optimally about 250 psi of internal pressure is required for simulating near operating conditions of blade member 34 exerting 2 lbs. of force at 0.008 inch deflection.

In operation, production tests indicate that elastomeric biasing member or spring 40 of slitter cutting element 30 should be radially restrained to prevent the elastomeric biasing member or spring 40 from radially expanding during use, typically under high operating speeds. We found that radial expansion of elastomeric biasing member or spring 40 may be controlled in several ways, preferably by bonding the elastomeric biasing member or spring 40 to blade carrier 22 using an adhesive system suitable for bonding. Alternatively, radial expansion of elastomeric biasing member or spring 40 can be controlled by bonding the elastomeric biasing member or spring 40 to a thin metallic (or other high modulus material) support ring (not shown). Moreover, radial expansion of elastomeric biasing member or spring 40 may be controlled by any of the following techniques, including: providing a mechanical restraint within the design of blade carrier 22; casting or bonding a high durometer (high modulus) elastomer to the base of the resilient elastomeric biasing member or spring 40 (dual durometer spring); and, using a wire ring casted inside the elastomer biasing member or spring 40.

Figure 8A:
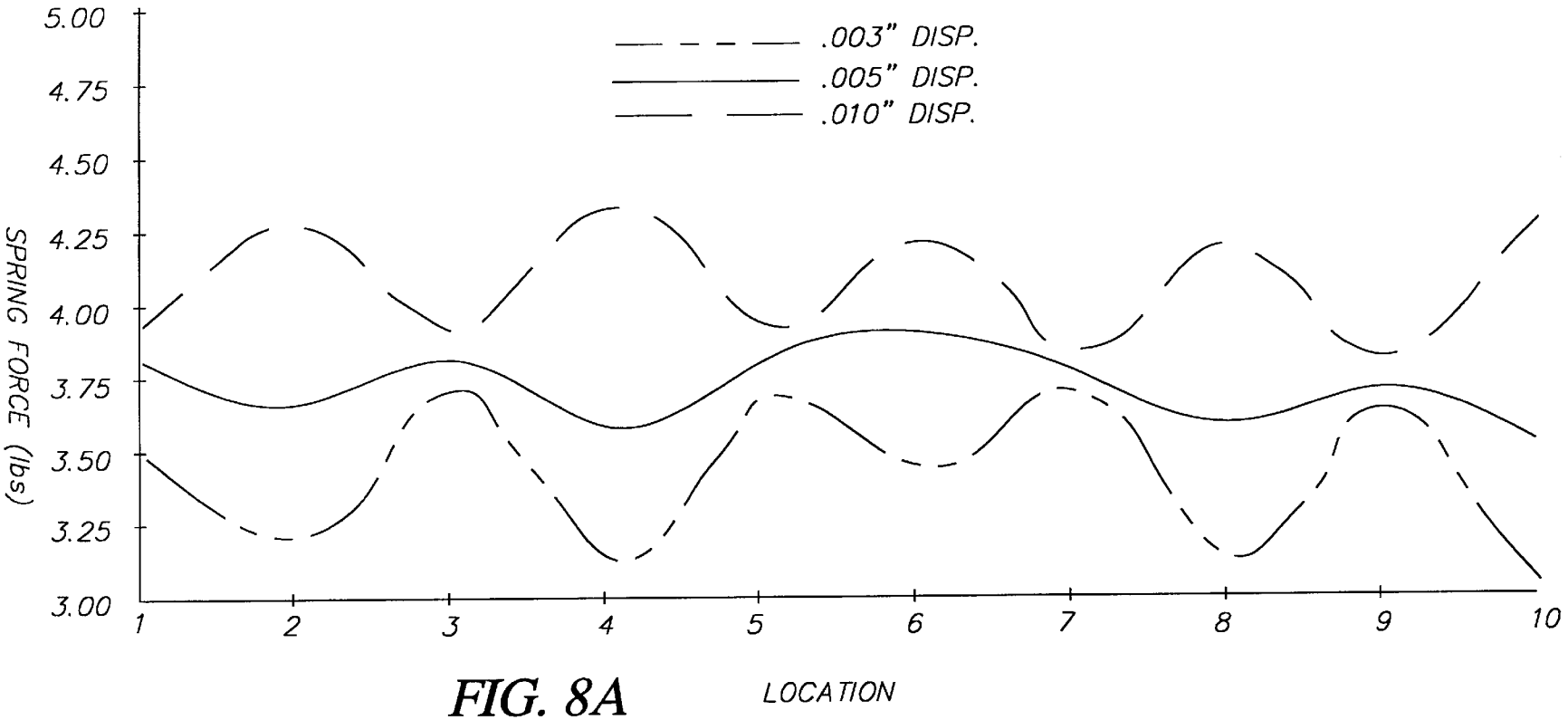
FIG. 8A (PRIOR ART)
FIGS. 8A and 8B are graphs of the typical spring force at various circumferential locations around a slitter knife assembly with prior art coil springs.
Figure 8B:
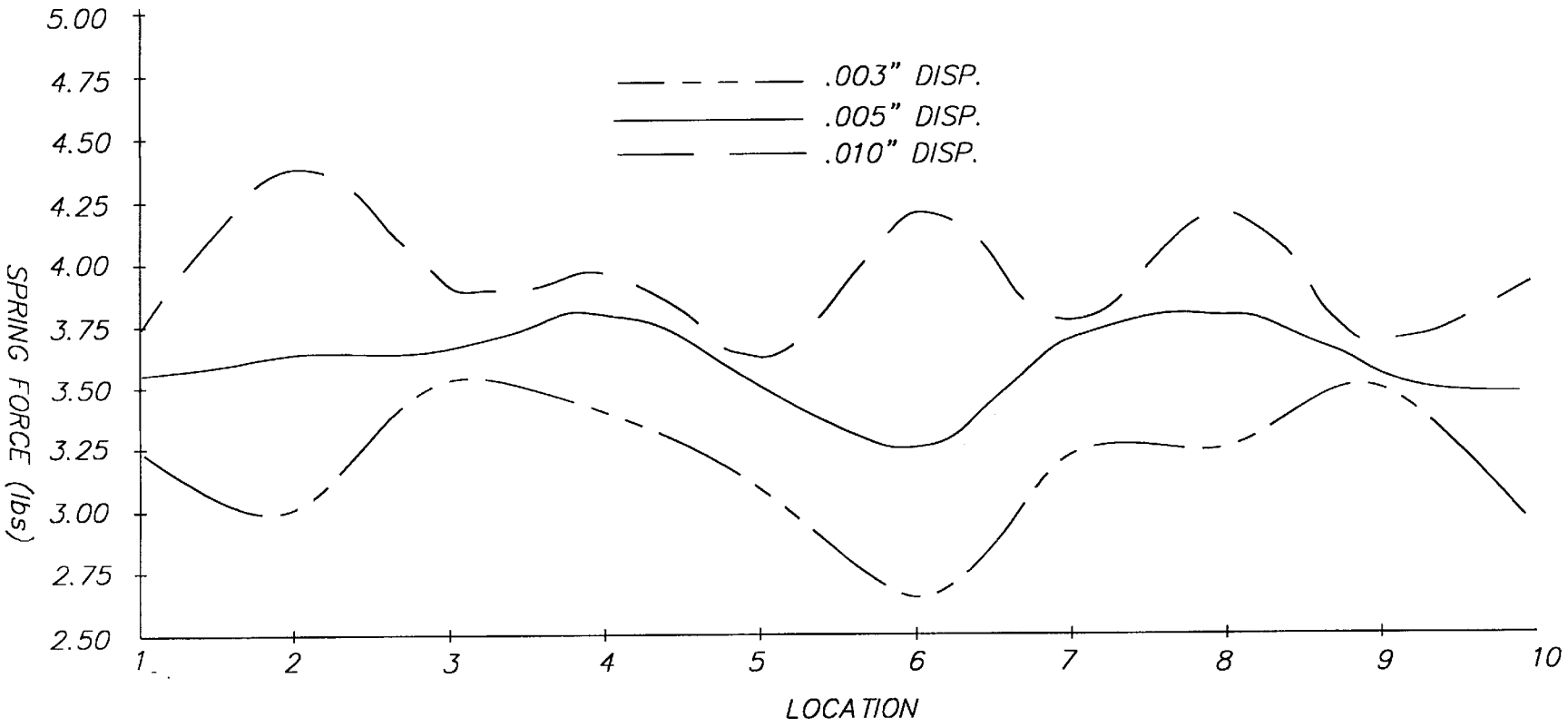
FIG. 8B (PRIOR ART)

Depicted in FIGS. 8A–8B, 9A–9B, and 10A–10B, spring force test of prior art springs (FIGS. 8A–8B and 9A–9B) and the elastomeric biasing member or spring 40 (FIGS. 10A–10B) of the invention are shown for comparison purposes. Spring force data was obtained using a well-known Finishing Assurance Center (FAC) spring force gauge. In FIGS. 8A–8B, spring force data for two different coil knives is illustrated. The spring force was measured at ten (10) locations around the blade (36°). Th trend depicted in both FIGS. 8A and 8B indicates that the spring force (lbs.) is undesirably quite variable around the blade, displaying multiple and frequently occurring peaks and valleys. Referring to FIG. 8A, the least variable force is about 0.25 lbs. around the blade. At the other extreme, we found that the most variable force is about 0.75 lbs. around the blade, as illustrated in FIG. 8B.

Figure 9A:
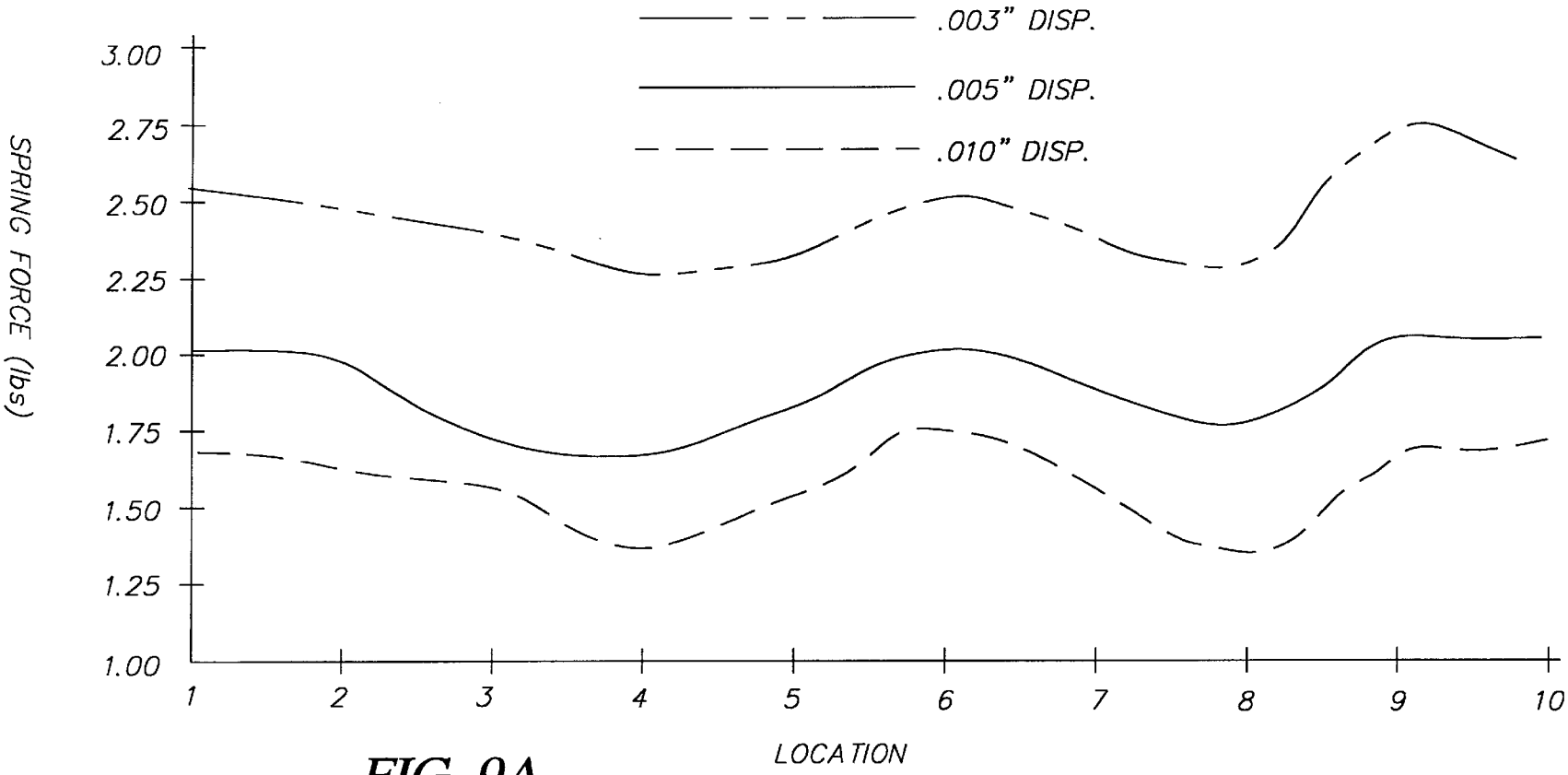
FIG. 9A (PRIOR ART)
FIGS. 9A and 9B are graphs of the typical spring force at various circumferential locations around a slitter knife assembly with prior art Belleville springs.
Figure 9B:
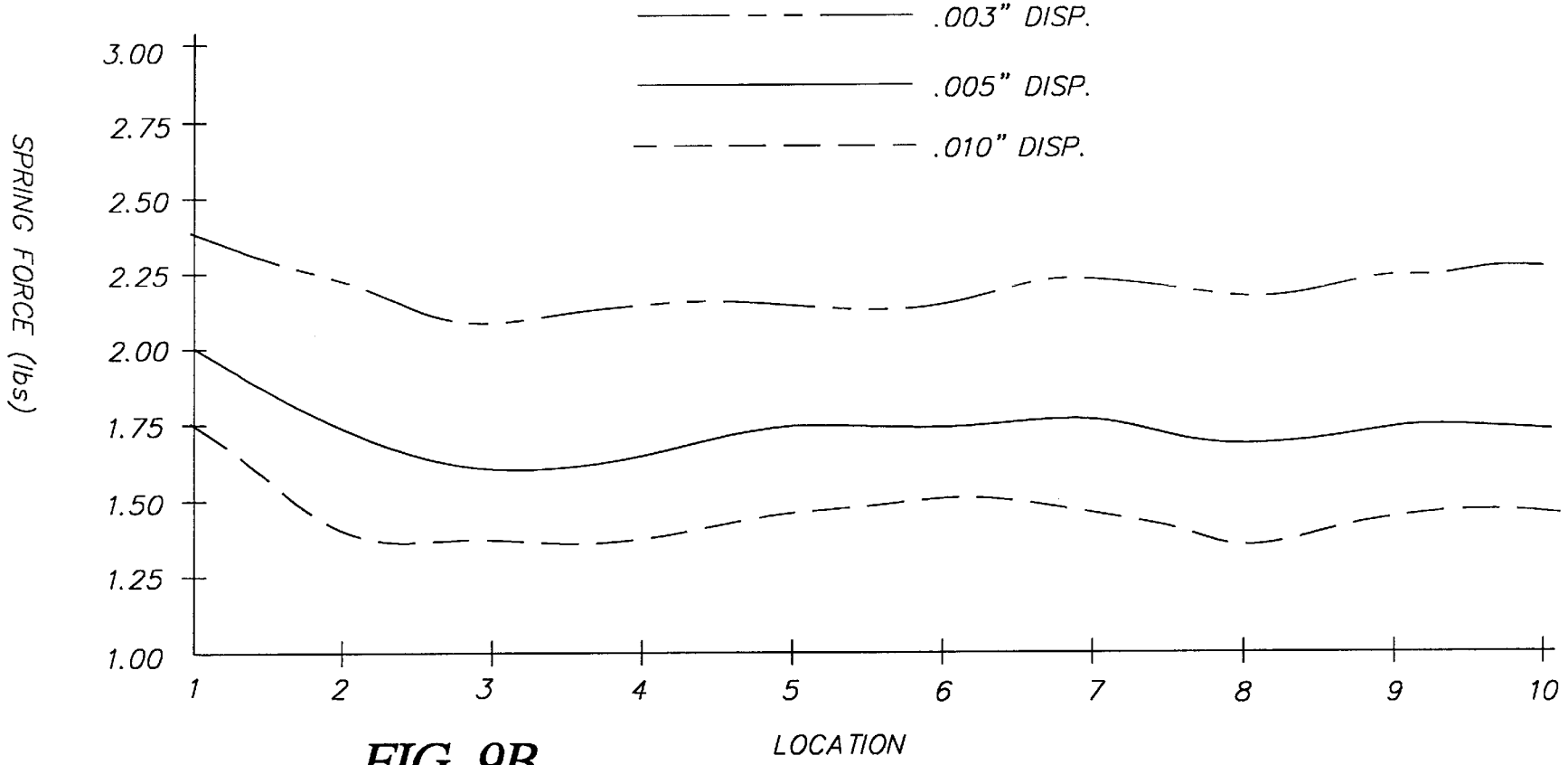
FIG. 9B (PRIOR ART)

Similarly, in FIGS. 9A–9B, the spring force variability range between about 0.375 lbs. (FIG. 9B) around the blade to about 0.50 lbs. (FIG. 9A) around the blade. Similar to FIGS. 8A and 8B note also the multiple and frequent peaks and valleys displayed in the spring force trend at various locations around the blade.

Figure 10A:
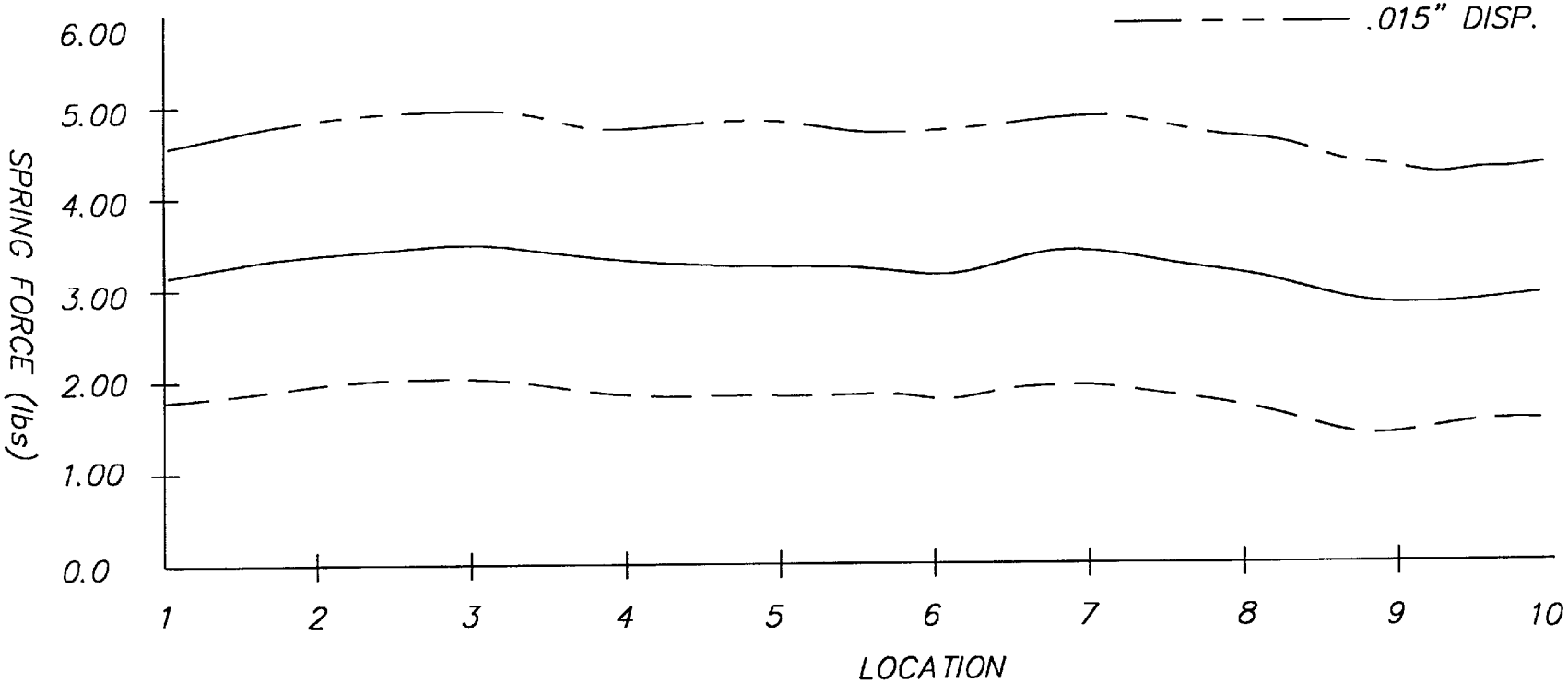
FIGS. 10A and 10B are graphs of the typical spring force at various circumferential locations around a slitter knife assembly with elastomeric springs of the invention.
Figure 10B:
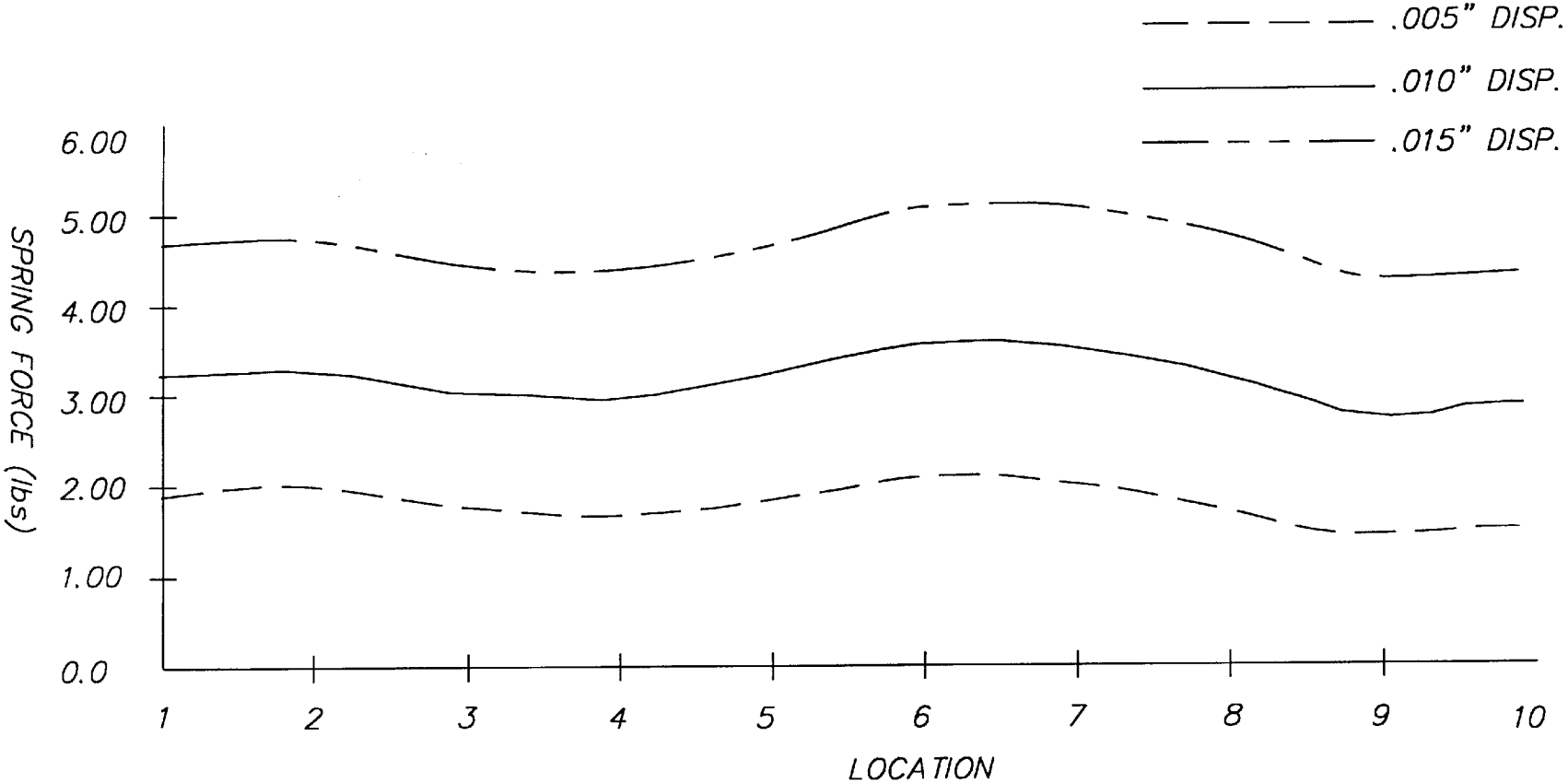

Referring to FIGS. 10A–10B, to our surprise, the spring force trend of the elastomeric biasing member or spring 40 used in our slitter cutting element 30 (two different blade members were tested) did not display the frequent and variable amplitude peaks and valleys around the blade, when compared with the trend shown in FIGS. 8A–8B and 9A–9B. This nearly uniform spring force profile illustrated in FIGS. 10A–10B is preferable over prior art developments because it favors longer knife wear and slitter production quality.

In another embodiment of the invention, a method of making a slitter cutting element 30 comprises the steps of providing a blade carrier 22 (as described above) and providing a blade member 34 (as described herein) configured for arranging on the blade carrier. Moreover, an elastomeric biasing member or spring 40 (as described) is provided and is configured for arranging on the blade carrier 22. According to the method, the elastomeric biasing member or spring 40 is arranged on the blade carrier 22 for continuous biasing contact with a non-active face (i.e., non-shearing face) 44 of blade member 34.

Figure 11:
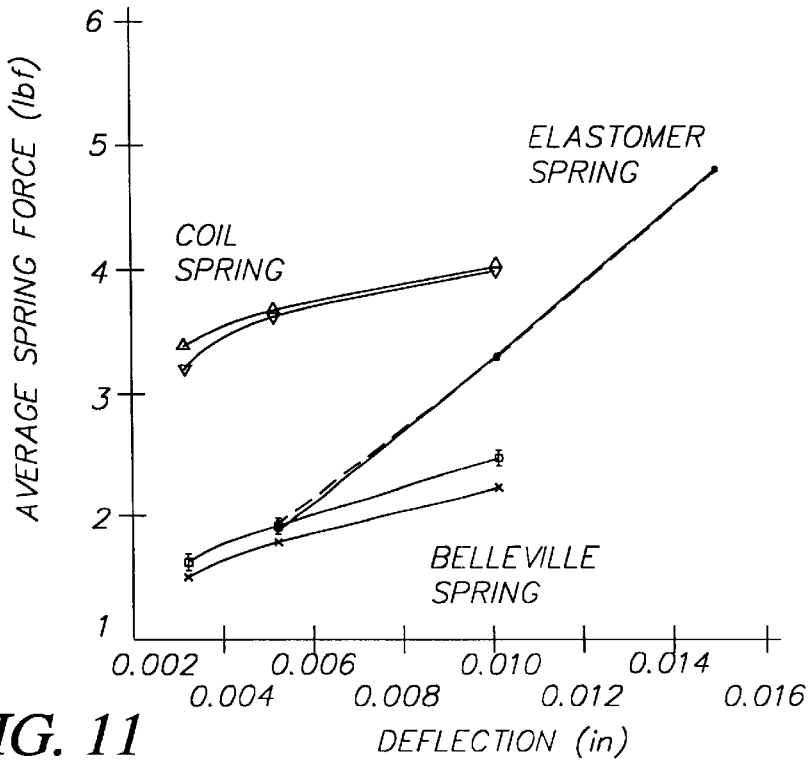
FIG. 11 is a graph that compares the average spring force of prior art coil springs and Belleville springs to the elastomeric springs of the invention as a function of deflection; and, FIG. 12 is a perspective view of a slitter apparatus according the principles of the invention.

Referring to FIG. 11, a comparison of the average spring force at varying blade member deflections for prior art (coil and Belleville) springs and the elastomeric biasing member or spring 40 design of the invention is illustrated. The results clearly show that the elastomeric biasing member or spring 40 biasing blade member 34 of the invention is generally linear compared with prior art springs. This linearity makes the spring force easily predictable at any deflection. In contrast, curves exhibited by the two prior art springs are generally non-linear and, therefore, less predictable compared with the elastomeric biasing member or spring 40 used in the invention.

Figure 12:
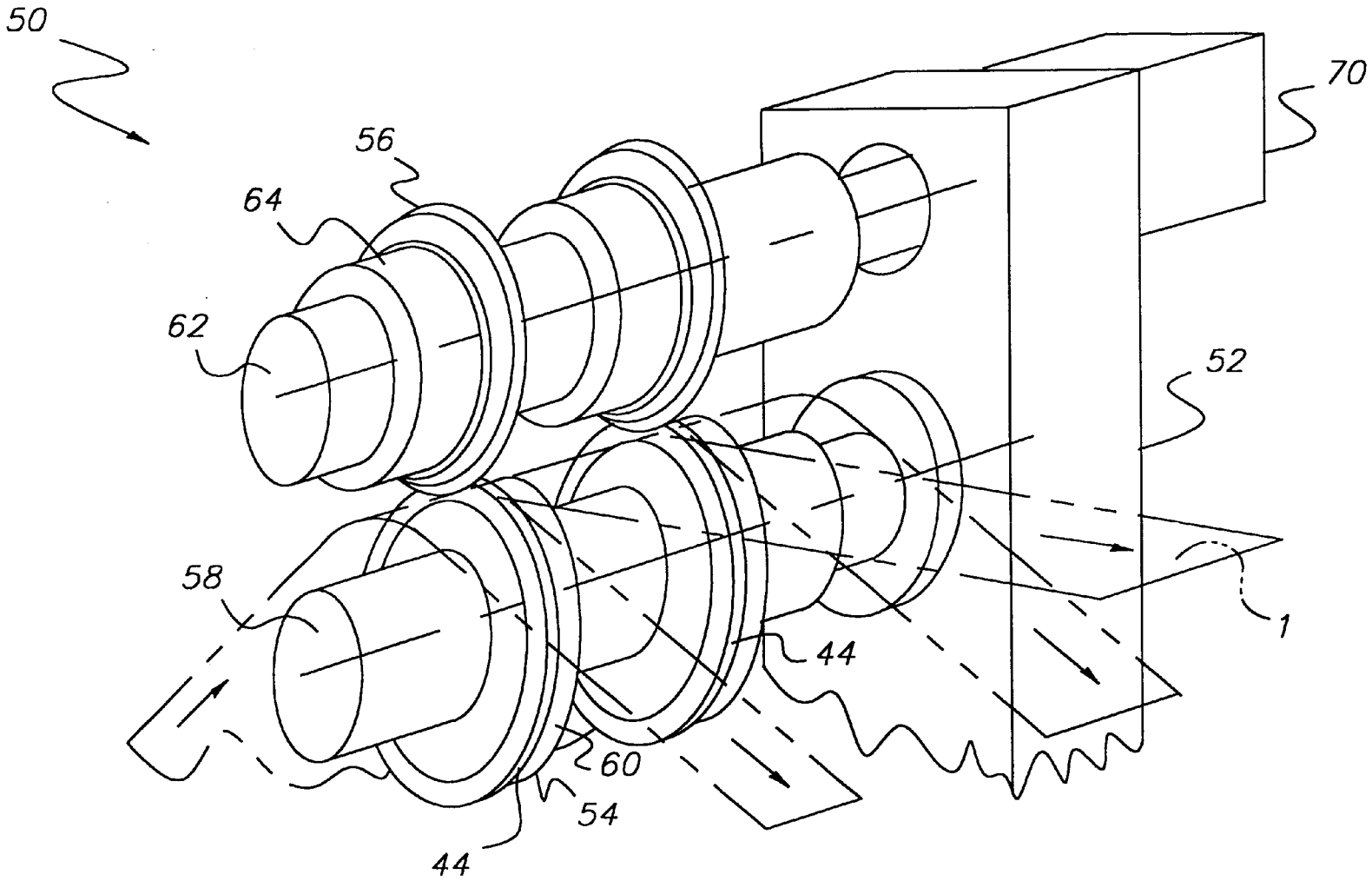

Referring now to FIG. 12, according to another embodiment of the invention, apparatus 50 for slitting a sheet of web material 1, such as photographic paper or film, has a substantially rigid frame 52 and at least one first blade member 54 and at least one second blade member 56 both fixedly attached to frame 52. As seen in FIG. 12, a first shaft 58 bearing first blade carrier 60 is rotatably supported in frame 52. Moreover, a second shaft 62 spaced apart in frame 52 from first shaft 58 bears a second blade carrier 64. First blade member 54 rotates in a fixed, stationary plane on first blade carrier 60 relative to frame 52. Rotatable second blade member 56 is axially displaceable on second blade carrier 64 relative to frame 52. According to FIG. 6A, axially displaceable second blade member 56, in this embodiment of the invention, is biased by an elastomeric biasing member or spring 40, as described in details above.

It is within the contemplation of the invention that multiple identical first blade members 54 and multiple identical second blade members 56 may be configured to operate in tandem in a slitter, as illustrated in FIG. 12. For simplicity, however, we will describe only one such arrangement of first and second cooperating blade members 54, 56. Therefore, a first blade member 54 is arranged on first blade carrier 60. Similarly, second blade member 56 is arranged on second blade carrier 64 for axial displacement relative to frame 52.

Referring again to FIG. 12, apparatus 50 for slitting a sheet of web material 1 further includes means 70 for urging the second blade member 56 into axial engagement with a corresponding first blade member 54. Skilled artisans will appreciate that means 70 may include, but is not limited to: air pressure (not shown), rack and pinion gears, threaded rod, a solenoid. For simplicity, we prefer using rack and pinion gears.

The invention, therefore, has been described with reference to a preferred embodiment. However, it will be appreciated that variations and modifications can be effected by a person of ordinary skill in the art without departing from the scope of the invention.

PARTS LIST

1 sheet of web material
10 slitter knife
12 prior art displaceable blade member assembly
14 spring system
16 prior art coil spring
18 prior art Belleville spring
20 prior art garter spring
22 knife or blade carrier
24 retainer ring
26 screws
30 slitter cutting element
34 blade member
36 groove or recess
40 elastomeric biasing member or spring
42 dome-liked shaped portion of elastomeric biasing member or spring 40
44 inactive or non-shearing face of blade member
46 retainer
50 slitting apparatus
52 rigid frame of apparatus 50
54 first blade member
56 second blade member
58 first shaft
60 first blade carrier
62 second shaft
64 second blade carrier
70 means for urging

What is claimed is:

1. A slitter cutting element, comprising:

a cylindrical blade carrier having an axis and a radius and defining a recess; and, a circular blade member arranged on said cylindrical blade carrier, said blade member having an active face and an inactive face;

an elastomeric biasing member bonded in said recess, said elastomeric biasing member having a main portion and a dome-shaped portion extending outward from said main portion towards said blade member, said dome-shaped portion providing continuous biasing contact with said inactive face of said circular blade member so as to exert an evenly distributed force about the inactive face of the circular blade in response to an opposing force on said active face of said circular blade member; and means for restraining the elastomeric biasing member from radial expansion, said means for restraining comprising bonding said elastomeric biasing member to said cylindrical blade carrier.

2. The element recited in claim 1 wherein said elastomeric biasing member is a spring comprising a material selected from the group consisting of:

(a) polyester polyurethane;

(b) neoprene rubber;

(c) silicone elastomer;

(d) ethylene proprolyene rubber; and (e) nitrile rubber.

3. The element recited in claim 1 wherein said elastomeric biasing member has a Shore A hardness in a range of about 20–70.

4. The element recited in claim 1 wherein said elastomeric biasing member has a compression modulus in a range of about 200 psi and 2200 psi at 10% compressive strain.

5. The element recited in claim 1 wherein said dome-shaped portion of said elastomeric biasing member imparts a preload for said blade member.

6. Method of making a slitter cutting element, comprising the steps of:

(a) providing a cylindrical blade carrier having an axis and a radius;

(b) providing a circular blade member configured for arranging on said blade carrier, said circular blade member having an inactive face and an opposed active face;

(c) providing an elastomeric biasing member configured for arranging on said blade carrier, said elastomeric biasing member being provided with a main portion and a dome-shaped portion protruding beyond the main portion;

(d) arranging said main portion of said elastomeric biasing member on said blade carrier;

(e) arranging said blade member on said blade carrier so that said inactive face of said blade member is in intimate biasing contact with said dome-shaped portion of said elastomeric biasing member such that the dome-shaped portion exerts an evenly distributed opposing force about the inactive face of the circular blade member in response to an opposing force exerted on said active face of said blade member; and (f) restraining the elastomeric biasing member from radial expansion.

7. The method recited in claim 6 wherein said step of restraining said biasing member includes the step of bonding said main portion of said elastomeric biasing member to said blade carrier.

* * * * *